US007471265B2

(12) United States Patent
Kim et al.

(10) Patent No.: US 7,471,265 B2
(45) Date of Patent: Dec. 30, 2008

(54) PLASMA DISPLAY PANEL AND DRIVING METHOD THEREOF

(75) Inventors: Myoung-Kwan Kim, Suwon-si (KR); Ho-Young Ahn, Suwon-si (KR); Tae-Kyoung Kang, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 740 days.

(21) Appl. No.: 11/136,431

(22) Filed: May 25, 2005

(65) Prior Publication Data

US 2005/0264488 A1 Dec. 1, 2005

(30) Foreign Application Priority Data

May 28, 2004 (KR) ..... 10-2004-0038253

(51) Int. Cl.
*G09G 3/28* (2006.01)

(52) U.S. Cl. ..... 345/60; 345/66

(58) Field of Classification Search ..... 313/582, 313/584, 586; 315/169.1, 169.4; 345/37, 345/60–68

See application file for complete search history.

(56) References Cited

U.S. PATENT DOCUMENTS 6,963,320 B2 * 11/2005 Kanazawa ..... 345/60
7,352,341 B2 * 4/2008 Chae et al. ..... 345/60
2004/0189589 A1 * 9/2004 Nagase ..... 345/100
2007/0109227 A1 * 5/2007 Myoung et al. ..... 345/67

FOREIGN PATENT DOCUMENTS

| | | |
|---|---|---|
| JP | 2000-261739 | 9/2000 |
| JP | 2000-305513 | 11/2000 |
| JP | 2000-330510 | 11/2000 |
| JP | 2002-328648 | 11/2002 |
| JP | 2004-109838 | 4/2004 |

* cited by examiner

*Primary Examiner*—Nitin Patel
(74) *Attorney, Agent, or Firm*—H. C. Park & Associates, PLC

(57) ABSTRACT

A plasma display panel is provided having a plurality of scan electrodes and sustain electrodes formed parallel to each other in pairs on a first substrate, and a plurality of address electrodes formed on a second substrate that cross the plurality of first and second electrode pairs. A reset waveform is applied to a scan electrode during a reset period, and a scan pulse that falls from a first voltage level to a second voltage level is applied to the can electrode during an address period. A pre-scan pulse of a third voltage level, which is higher than the first voltage level, is applied to a scan electrode between the reset and address periods, and either a magnitude of the third voltage level or a width of the pre-scan pulse is adjusted according to patterns of subfield data.

10 Claims, 12 Drawing Sheets

Dot on/off

Full White

PLASMA DISPLAY PANEL AND DRIVING METHOD THEREOF

CROSS-REFERENCE TO RELATED APPLICATION

This application claims priority to and the benefit of Korean Patent Application 10-2004-0038253 filed on May 28, 2004 in the Korean Intellectual Property Office, which is incorporated herein by reference.

FIELD OF THE INVENTION

The present invention relates to a plasma display panel (PDP), and in particular, a method for driving a PDP in a low voltage addressing operation.

BACKGROUND OF THE INVENTION

Generally, a PDP is a flat panel display that uses plasma generated by a gas discharge to display characters or images. A PDP may include, depending on its size, thousands to millions of pixels arranged in a matrix format.

As shown in FIG. 1, a PDP includes opposing glass substrates 1 and 6 facing each other with a discharge space 11 disposed therebetween. A plurality of scan electrodes 4 and sustain electrodes 5 are arranged in parallel pairs on a first glass substrate 1 and extend along a first direction. Scan electrodes 4 and sustain electrodes 5 are covered by a dielectric layer 2 and a protective layer 3. A plurality of address electrodes 8 are formed on a second glass substrate 6 and extend along a second direction, which is substantially perpendicular to the first direction. Address electrodes 8 are covered by an insulator layer 7 having barrier ribs 9 formed thereon, that are between address electrodes 8. Phosphors 10 are disposed on a surface of insulator layer 7 facing glass substrate 1 and on both sides of barrier ribs 9. A discharge cell 12 is formed within discharge space 11 at an intersection of an address electrode 8 and a pair of scan and sustain electrodes 4 and 5. A wall charge results from an address discharge generated between address electrode 8 and scan electrode 4 in a discharge cell 12, which is then sustained by the repeated generation of a sustain discharge between scan electrode 4 and sustain electrode 5 to display an image.

Wall charges are the charges that form and accumulate on a wall (e.g., a dielectric layer) proximate to an electrode of a discharge cell. These wall charges will be described as being "formed" or "accumulated" on the electrode, although the wall charges do not actually touch the electrodes.

The barrier rib defining a discharge space prevents an erroneous operation (i.e., cross talk) between adjacent pixels by intercepting light generated during the discharge. A PDP includes a plurality of pixels arranged in a matrix format, wherein each pixel includes a surface coated with phosphors. A commonly-used PDP produces desired colors by exciting the phosphors coated on the inner wall of the pixels with ultraviolet rays caused by a sustain discharge.

Referring to FIG. 2, electrodes of a PDP are arranged in a matrix configuration, wherein the address electrodes $A_1$ to $A_m$ are arranged in columns, and the pairs of scan electrodes $Y_1$ to $Y_n$ and sustain electrodes $X_1$ to $X_n$ are arranged in rows.

At present, one frame (i.e., one TV field) may be divided into a plurality of subfields, which are subjected to time division control for displaying intermediate gray-scale data of colors in the PDP.

As can be seen in FIG. 3, one TV field may be divided into 6 subfields, and each subfield includes an address period and a display discharge sustain period according to a 6-bit gray-scale data display method.

Further, looking at FIG. 4, the capacitive component Ca+x is defined by a sum of a capacitive component Cx generated between the address electrodes and the pairs of sustain electrodes and a capacitive component Ca generated between the address electrodes.

SUMMARY OF THE INVENTION

The present invention provides a PDP and a method for driving the same having an advantage of realizing an efficient addressing operation at lower voltages.

The present invention discloses a PDP including a plurality of address electrodes, a plurality of scan electrodes, and a plurality of sustain electrodes. The PDP further includes a controller, an address electrode driver, a sustain electrode driver, and a scan electrode driver. The controller receives an image signal and generates subfield data to generate a scan electrode driving signal, a sustain electrode driving signal, and an address electrode driving signal. The scan electrode driver applies a voltage to the scan electrode, such that the scan driver applies a scan pulse that falls from a first voltage level to a second voltage level during an address period, and applies a pre-scan pulse of a third voltage level, which is higher than the first voltage level, between a reset period and the address period. The width of the pre-scan pulse is controlled according to patterns of subfield data.

In another embodiment of a PDP according to the present invention, the third voltage level of the pre-scan pulse is controlled according to patterns of subfield data.

A method for driving a PDP is disclosed that includes dividing a frame into a plurality of subfields, each of which may include a reset period, an address period, and a sustain period; applying to a scan electrode a reset waveform during a reset period, applying to the scan electrode a scan pulse that falls from a first voltage level to a second voltage level during an address period; applying to the scan electrode a pre-scan pulse of a third voltage level, which is higher than the first voltage level, between the reset period and the address period; and adjusting the pre-scan pulse according to patterns of subfield data.

DETAILED DESCRIPTION OF THE EMBODIMENTS

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and accompanying detailed description are to be regarded as illustrative in nature, and not restrictive.

Figure 1:
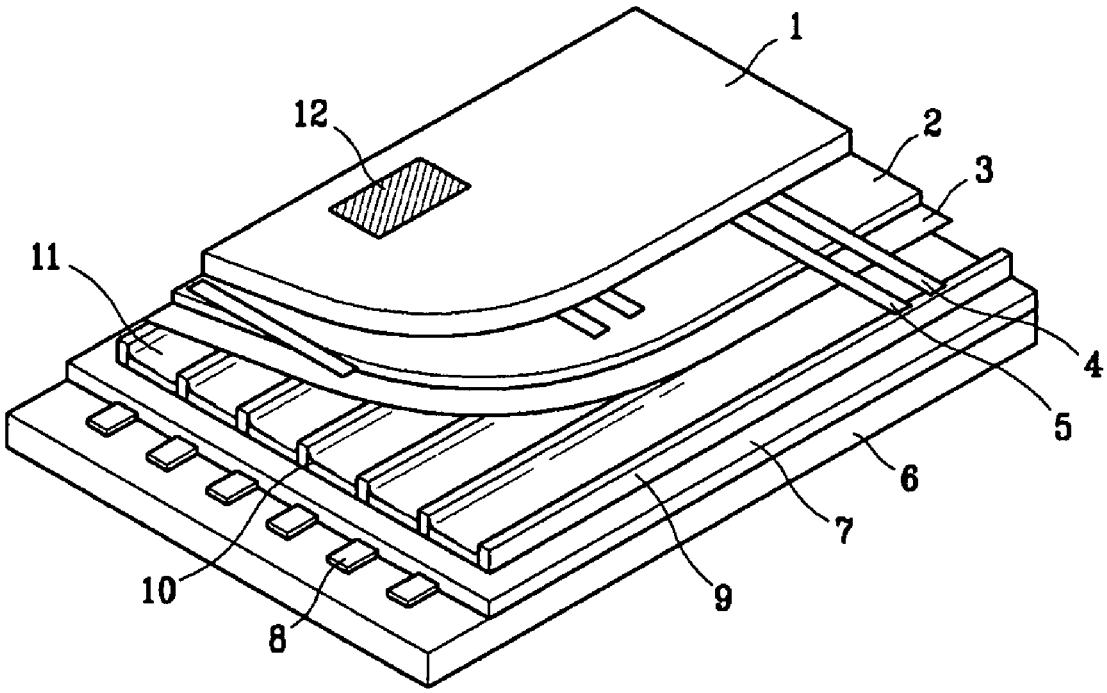
FIG.1 (Related Art)
FIG. 1 is a partial perspective view schematically illustrating a general PDP.
Figure 2:
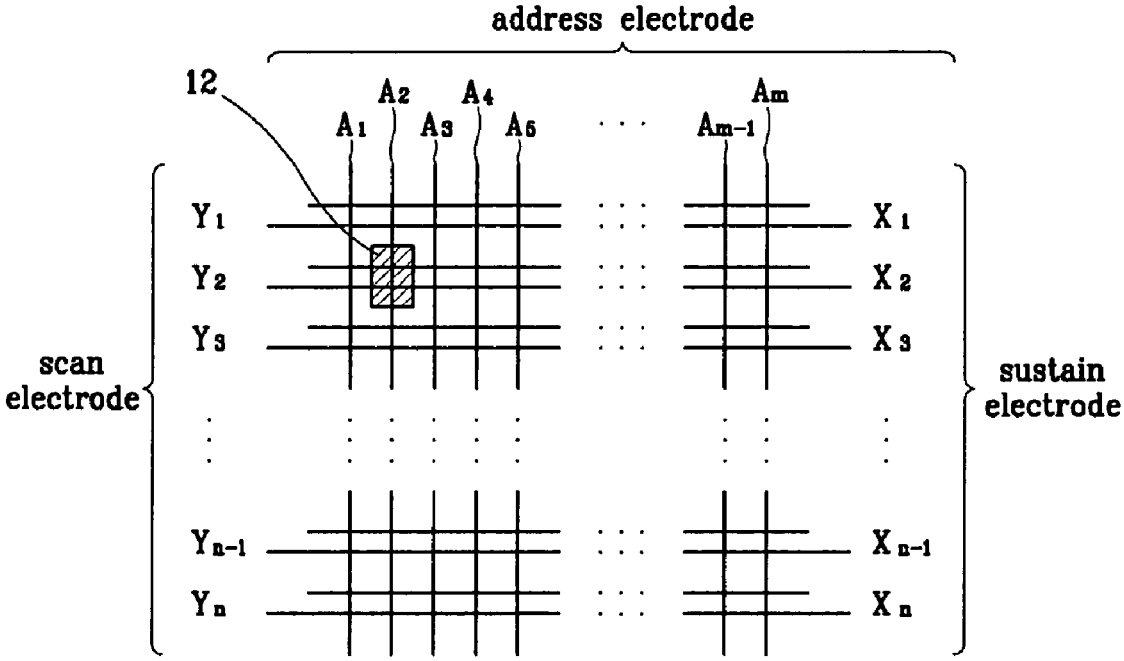
FIG.2 (Related Art)
FIG. 2 is a typical electrode arrangement diagram of a PDP.
Figure 3:
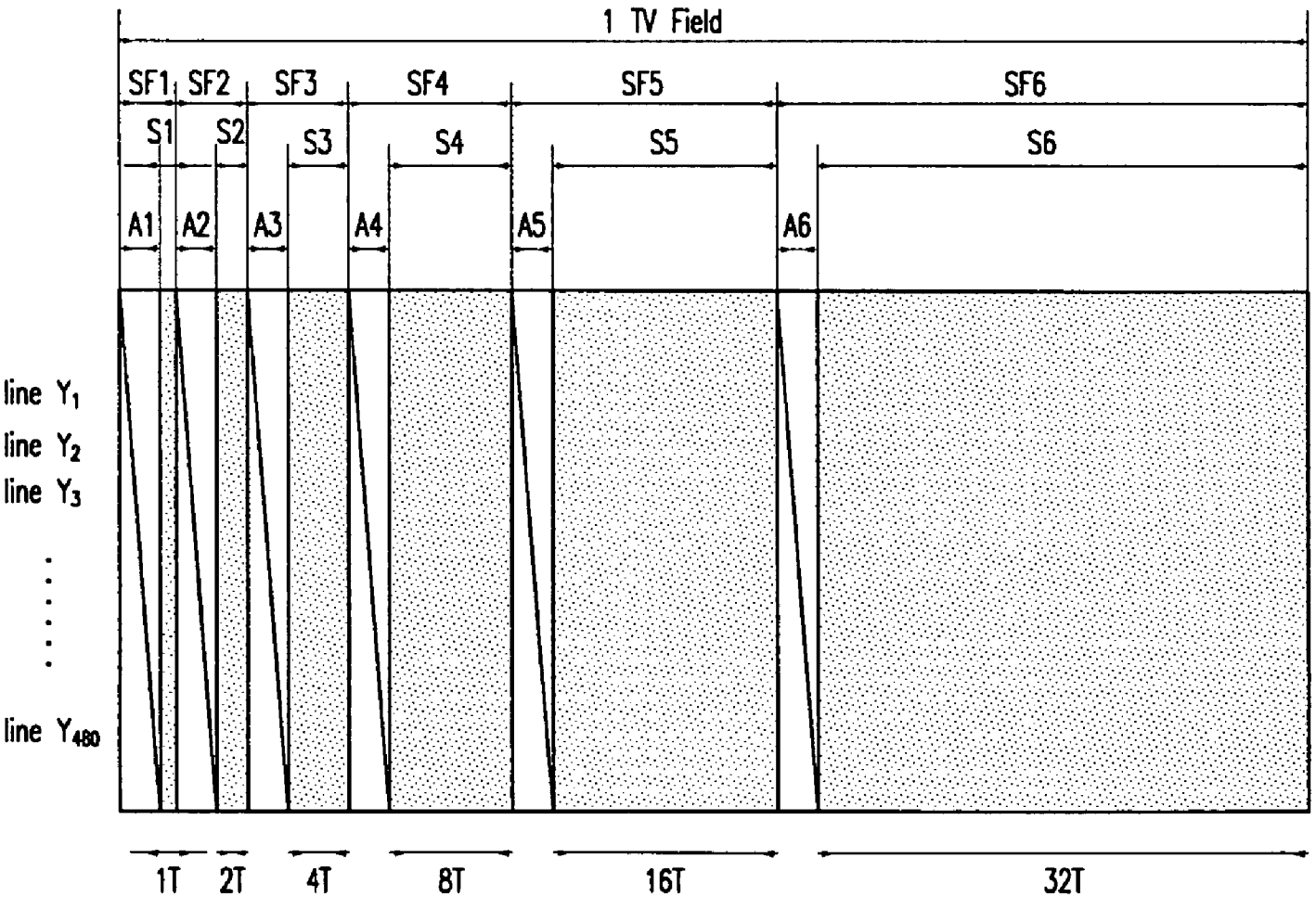
FIG.3 (Related Art)
FIG. 3 illustrates a typical method for displaying intermediate grays-scale data in a PDP.
Figure 4:
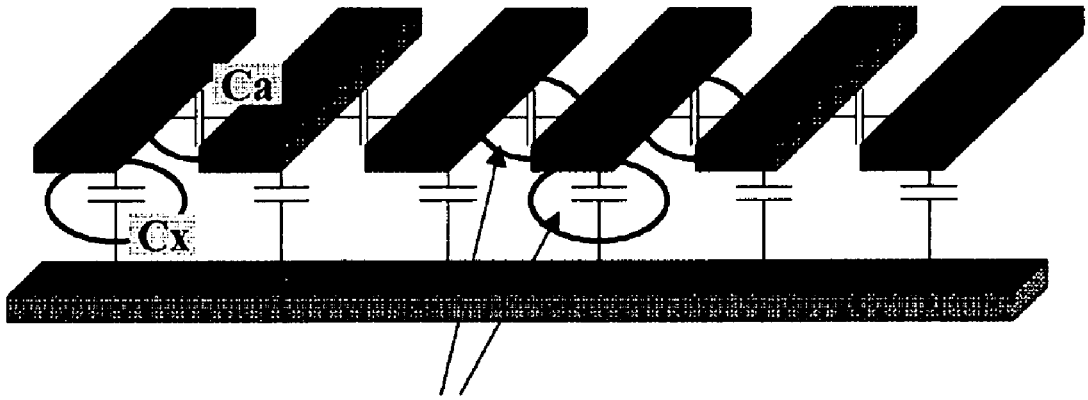
FIG. 4 illustrates the capacitance of a panel.
Figure 5:
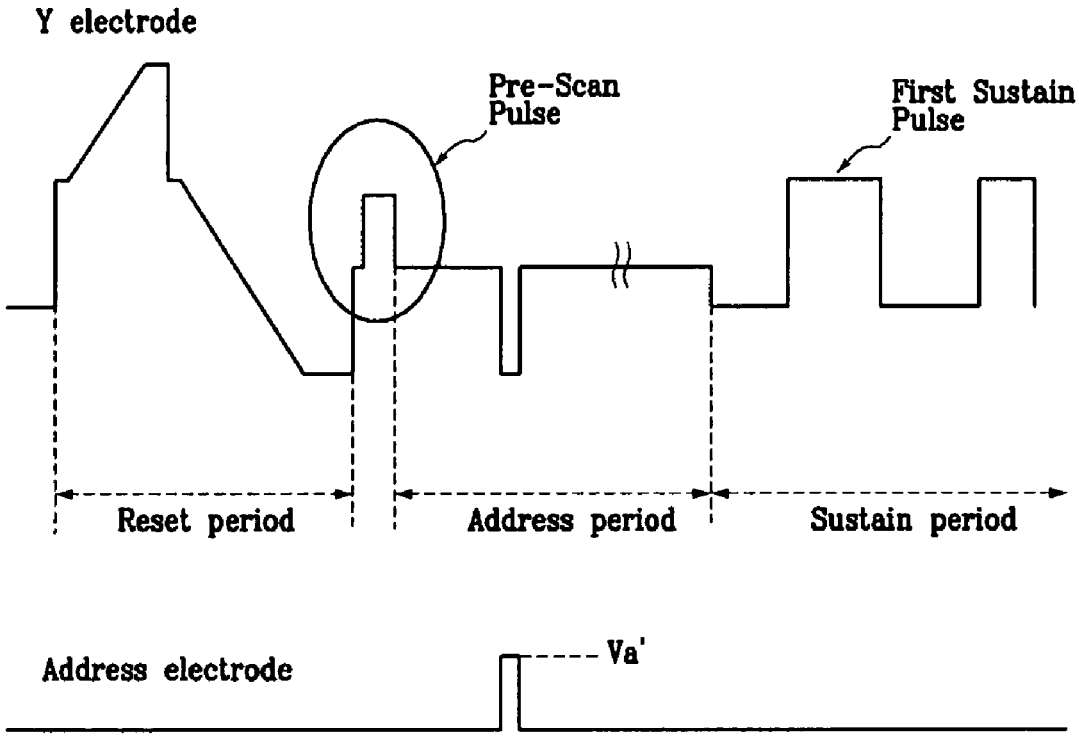
FIG. 5 illustrates a driving waveform of a PDP according to an embodiment of the present invention.

FIG. 5 illustrates waveforms of a scan (Y) electrode and an address (A) electrode of a PDP according to an embodiment of the present invention. A pre-scan pulse is applied to the Y electrode for a low voltage addressing operation. The waveform applied to a sustain (X) electrode, which is not shown, may be a conventional voltage waveform.

Referring to FIG. 5, an increased amount of negative wall charges (−) may be accumulated on the Y electrode when applying the pre-scan pulse to the Y electrode before an address period starts.

An increase in the accumulation of the wall charges enables generation of an address discharge even if the address voltage applied to the A electrode is reduced to a level Va', which is lower than a typical address voltage level. However, power consumption rapidly increases when address data or subfield data require many address pulse switching operations. In other words, when an address pulse switching operation is performed in response to image data, more reactive power is consumed by charging/discharging of the capacitive components Cx and Ca of the panel.

The address power consumption may vary greatly depending on the type of image displayed.

Figure 6:
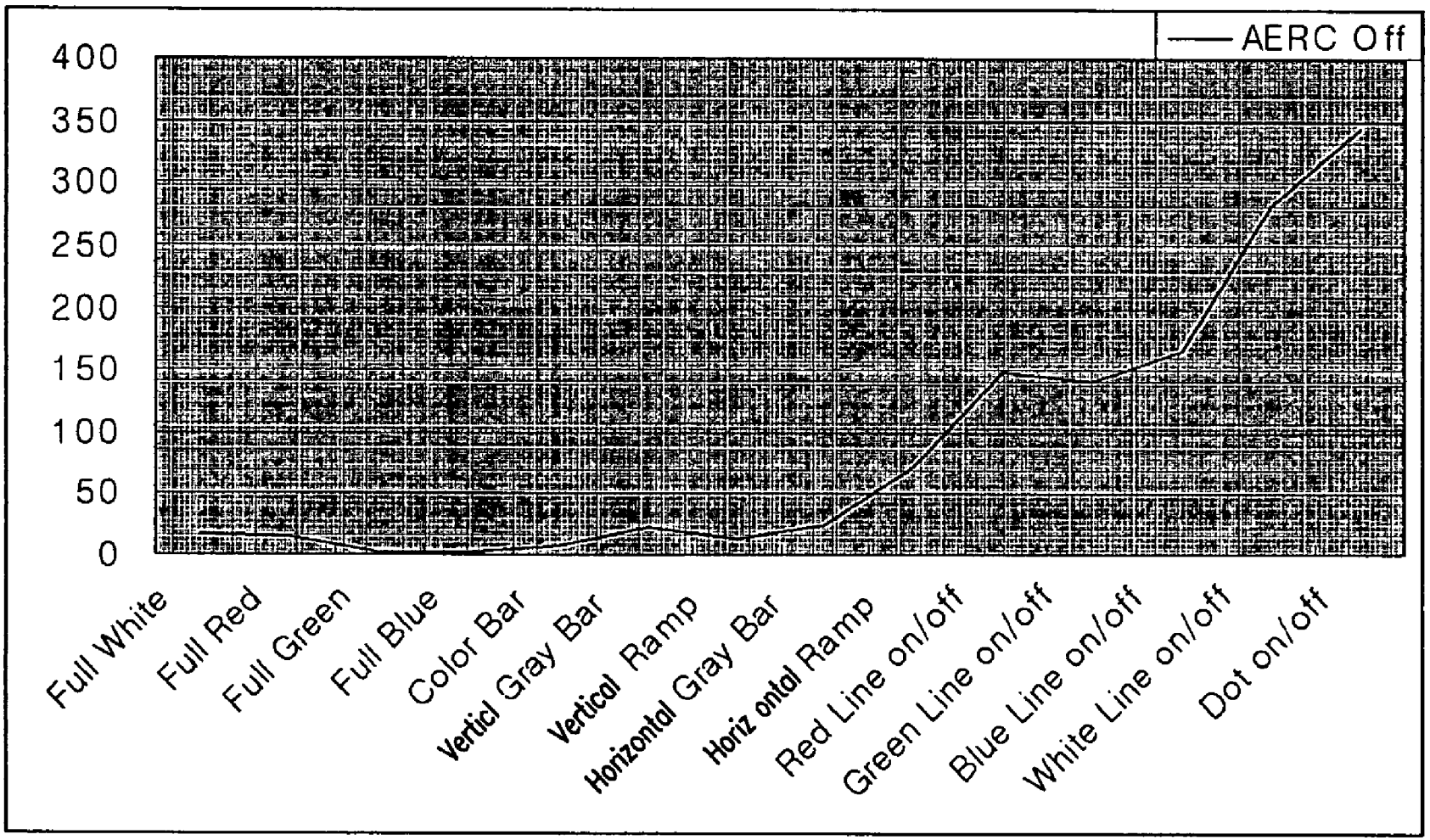
FIG. 6 illustrates characteristics of address power consumption according to types of images displayed.

FIG. 6 is a graph showing the address power consumption for different types of images when an address energy recovery circuit (AERC) is not utilized. Typically, the address power consumption is very low when displaying an image that requires few address pulse switching operations; however, this power consumption is very high when displaying an image requiring many address pulse switching operations.

Figure 7:
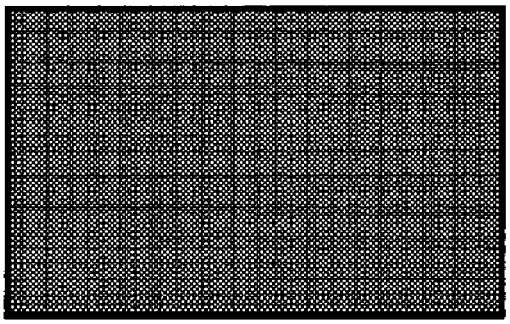
FIG. 7 shows a difference between an image generated by much address pulse switching and an image generated by little address pulse switching.
Figure 7:
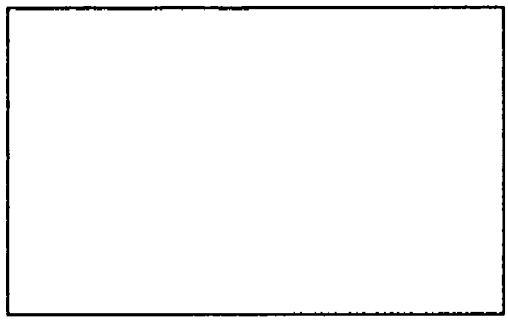

FIG. 7 illustrates an image (dot on/off) that requires many address pulse switching operations and another image (full white) that requires few address pulse switching operations.

In the case of the dot on/off image, many address pulse switching operations are required because the address data changes greatly between adjacent cells. The change of address data increases charging/discharging of the capacitive components, and accordingly, increases the overall address power consumption.

On the contrary, the full white image requires less address pulse switching operations because the address data changes little between adjacent cells and, thus, decreases charging/discharging the capacitive component, which decreases the address power consumption.

Therefore, when displaying an image requiring many address pulse switching operations, the address power consumption rapidly increases. Here, a switch mode power supply (SMPS) supplying a power to the PDP has a limited capacity, and, thus, a voltage drop may occur in the address voltage waveform applied to the A electrode when the address power consumption rapidly increases.

In the driving waveform of FIG. 5, the address voltage of the level Va' is already lower than a conventional address voltage because of the pre-scan pulse applied prior to the address period. Consequently, due to the limited capacity of the SMPS, the address voltage may fall below Va' as the address power consumption increases when address pulse switching operations are more frequently performed. When the address voltage drops below Va', address discharging may become unstable, which increases the possibility of misfiring.

A scheme for avoiding such a misfiring according to another embodiment of the present invention will now be described.

Figure 8:
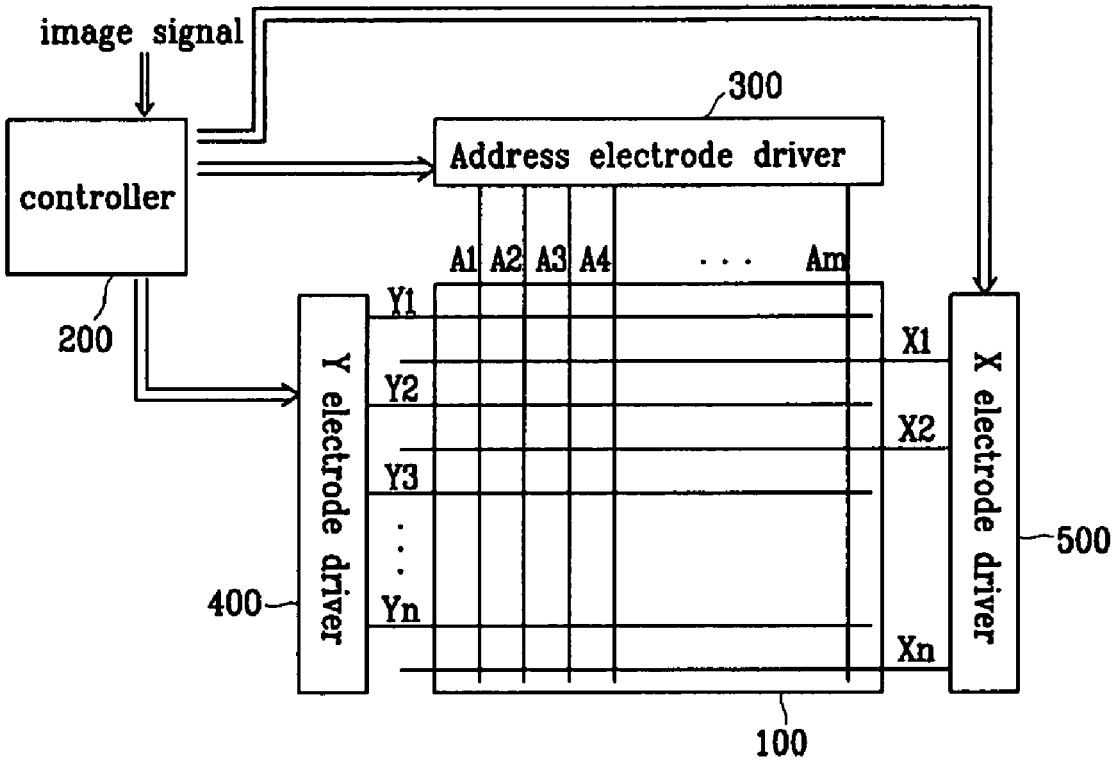
FIG. 8 is a schematic diagram of a PDP according to another embodiment of the present invention.

Referring to FIG. 8, the PDP includes a plasma panel 100, a controller 200, an A electrode driver 300, a Y electrode driver 400, and an X electrode driver 500.

Plasma panel 100 includes a plurality of A electrodes $A_1$-$A_m$ arranged in columns along a first direction, and a plurality of sustain electrodes $X_1$-$X_n$ and scan electrodes $Y_1$-$Y_n$ arranged in rows along a second direction. Each of the X electrodes $X_1$-$X_n$ has a corresponding Y electrode $Y_1$-$Y_n$. Generally, ends of the X electrodes share a connection in common. Plasma panel 100 includes a first glass substrate (not shown) on which the X and Y electrodes are arranged in parallel pairs and a second glass substrate (not shown) on which A electrodes are arranged. The glass substrates are disposed facing each other, with a discharge space therebetween, such that the pairs of X electrodes $X_1$-$X_n$ and Y electrodes $Y_1$-$Y_n$ may cross A electrodes $A_1$-$A_m$. A discharge cell is formed within the discharge space at an intersection of an address electrode and a pair of scan and sustain electrodes.

Controller 200 receives an image signal, and outputs an X electrode driving signal, a Y electrode driving signal, and an A electrode driving signal. Controller 200 divides one frame into a plurality of subfields, and each subfield may include a reset period, an address period, and a sustain period. In particular, Controller 200 generates subfield data, and applies a pre-scan pulse of a first voltage after the reset period and before the address period. The controller varies a width of the pre-scan pulse according to a pattern of the subfield data, and generates the Y electrode driving signal, the X electrode driving signal, and the address electrode driving signal that corresponds to the width of the pre-scan pulse.

Address electrode driver 300 receives the address electrode driving signal from controller 200, and applies a display data signal to each of the A electrodes $A_1$-$A_m$ to select a desired discharge cell. X electrode driver 500 receives the X electrode driving signal from controller 200, and applies a driving voltage to X electrodes $X_1$-$X_n$. Y electrode driver 400 receives the Y electrode driving signal from controller 200, and applies the driving voltage to Y electrodes $Y_1$-$Y_n$.

Figure 9:
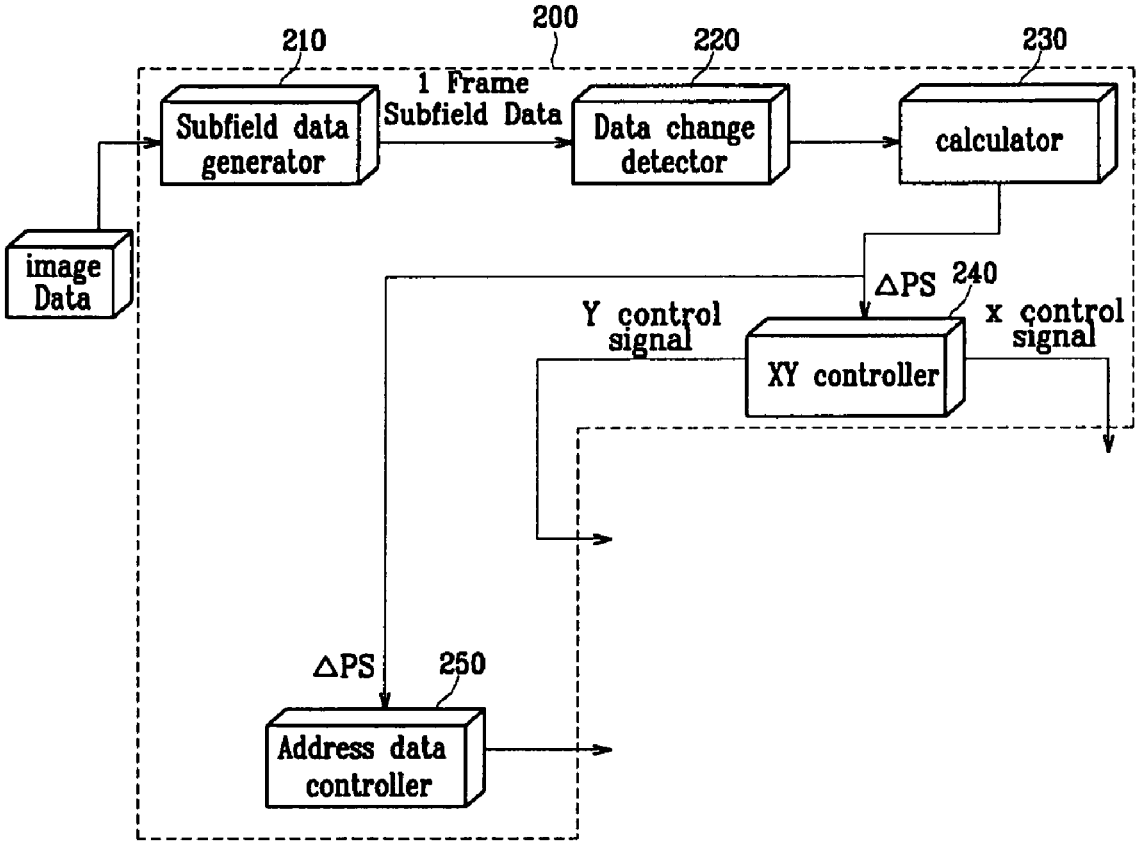
FIG. 9 is schematic block diagram of the controller of FIG. 8.

Referring to FIG. 9, controller 200 includes a subfield data generator 210, a data change detector 220, a calculator 230, an XY controller 240, and an address data controller 250.

Subfield data generator 210 receives an image signal and generates subfield data.

Data change detector 220 detects changes in the subfield data.

Calculator 230 calculates and outputs the width of the pre-scan pulse based on the changes to the subfield data.

XY controller 240 generates the Y electrode driving signal and the X electrode driving signal that correspond to the calculated width of the pre-scan pulse.

Address data controller 250 generates the A electrode driving signal that corresponds to the calculated width of the pre-scan pulse.

The operation of a PDP having the foregoing configuration will now be described in more detail.

Figure 10:
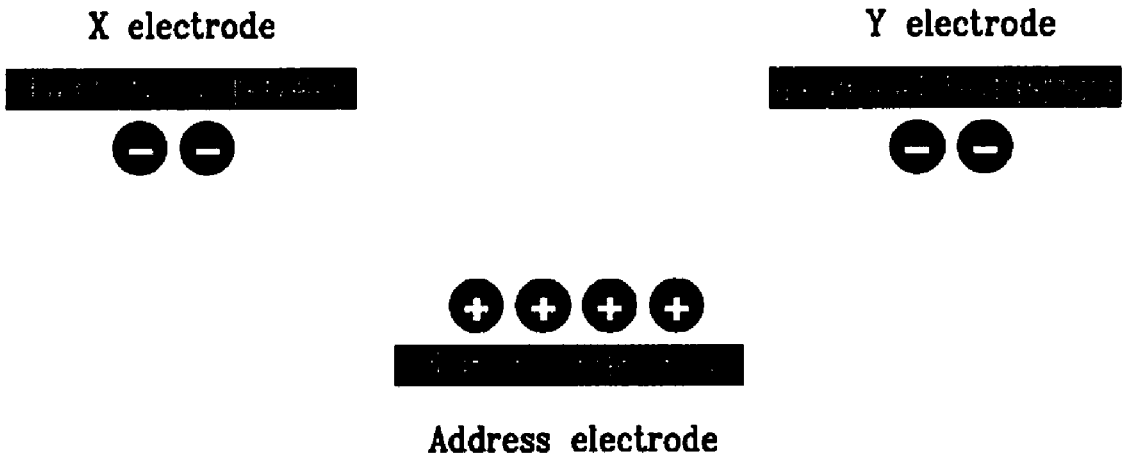
FIG. 10 illustrates the wall charge distribution in the X, Y, and address electrodes after a reset operation.

FIG. 10 illustrates the wall charge distribution in the X, Y, and A electrodes after a reset period.

Figure 11:
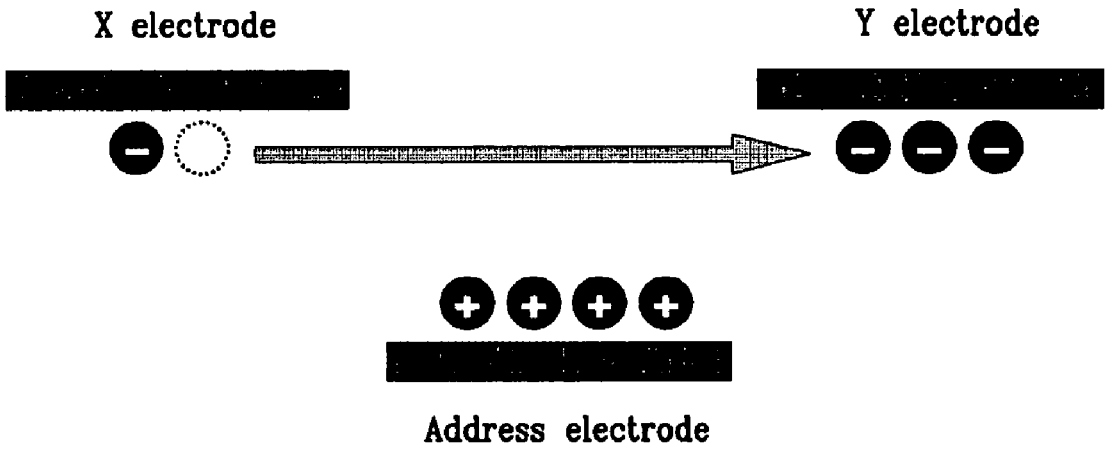
FIG. 11 illustrates the wall charge distribution when a pre-scan pulse is applied.

An address discharge is generated by the potential difference between the A electrode and the Y electrode. The address discharge is generated because wall charges are increased when a scan pulse having a negative potential (−) is applied to the Y electrode and an address pulse having a positive potential (+) is applied to the address electrode. The generation of the address discharge is facilitated by accumulating more wall charges on the electrodes after the reset operation. The distribution of wall charges in the case when a pre-scan pulse is applied to accumulate more wall charges is shown in FIG. 11.

Figure 12:
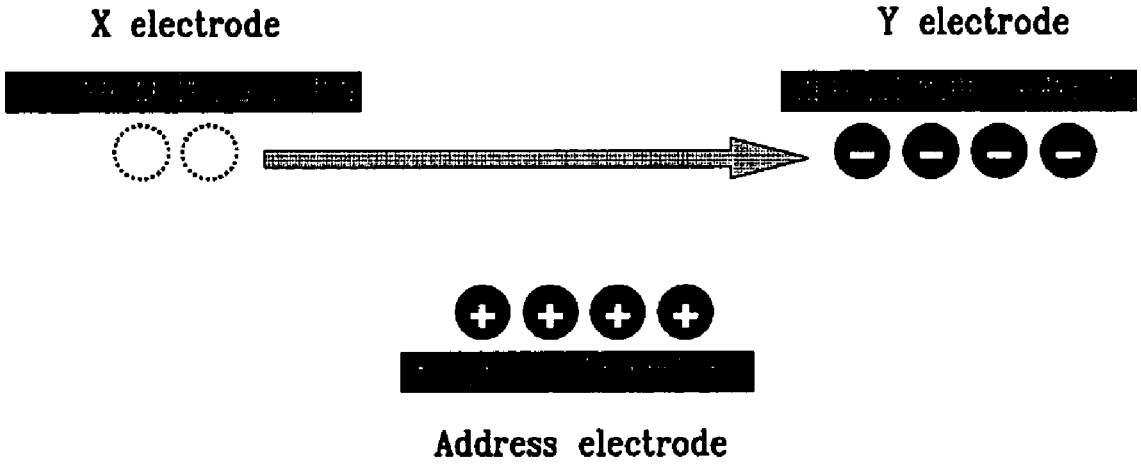
FIG. 12 illustrates the wall charge distribution when the width of the pre-scan pulse is increased.

When the pre-scan pulse is applied to facilitate generation of an address discharge, an increased amount of negative (−) wall charges accumulate on the Y electrode. As shown in FIG. 12, increasing the width of the pre-scan pulse will also increase the accumulation of negative (−) wall charges on the Y electrode.

According to another embodiment of the present invention, in the low voltage addressing operation, the accumulation of wall charges on the Y electrode is increased by controlling the width of the pre-scan pulse so as to prevent the misfiring caused by the drop of the address voltage below a level of Va' when an increase in address pulse switching operations occurs.

The operation of a PDP according to another embodiment of the present invention will now be described in more detail.

As before, subfield data generator 210 of controller 200 receives an image signal and outputs subfield data to be displayed on plasma panel 100. In another embodiment, however, data change detector 220 detects the changes to the address data for each subfield, and assigns the changed data a numerical value.

The calculator 230 then outputs a value for the width of the pre-scan pulse corresponding to the numerical value assigned to the changes in the address data. The width of the pre-scan pulse corresponding numerical value assigned to the changes in the address data may be retrieved from an internal memory (not shown) that stores the pre-scan pulse widths in a mapping table format, and other obvious schemes for storing the same may be adopted.

The width of the pre-scan pulse calculated for each subfield is transmitted to XY controller 240 and address data controller 250.

XY controller 240 generates driving waveforms by controlling the opening/closing timing of a switch (FET) of X and Y electrode drivers 400 and 500, and address data controller 250 generates the address data. Controllers 240 and 250 respectively generate a driving waveform and address data for each subfield based on the calculated width of the pre-scan pulse, wherein the width of the pre-scan pulse applied to the driving waveform is variable according to the address data. The width of the pre-scan pulse in the driving waveform applied to the Y electrode is variable, and the width of the pre-scan pulse is set to increase as address pulse switching operations increase.

Address electrode driver 300 receives the address electrode driving signal and applies the display data signal for selecting the desired discharge cells to the respective A electrodes $A_1$-$A_m$.

The X electrode driver 500 receives the X electrode driving signal and applies the driving voltage to the X electrodes $X_1$-$X_n$, and the Y electrode driver 400 receives the Y electrode driving signal and applies the driving voltage to the Y electrodes $Y_1$-$Y_n$. The plasma panel 100 is then enabled to display data thereon.

As described above, when the address data is frequently switched, address pulse switching operations increase and the charging/discharging of the capacitive component rapidly increases, which in turn causes a rapid increase in power consumption that may lead to misfiring.

According to another embodiment of the present invention, however, the instability of the address discharge that causes misfiring may be reduced by increasing the width of the pre-scan pulse to increase the accumulation of negative wall charges on the Y electrode.

Thus, although the address voltage may drop due to increased power consumption, the generation of the address discharge is stable because it is facilitated by the additional accumulation of negative wall charges on the Y electrode.

When the address pulse switching operation is performed less often, the address data switching operation is also performed less often and the charging/discharging of the capacitive component of the panel is correspondingly reduced. Accordingly, the rapid increase in power consumption described above may be prevented and the SMPS supplies a stable address voltage that generates a stable address discharge. In this case, brightness may be increased by reducing the width of the pre-scan pulse and increasing the sustain pulse, since additional negative wall charges need not be accumulated on the Y electrode.

According to another embodiment of the present invention, the width of the pre-scan pulse is controlled, but a voltage level of the pre-scan pulse may also be controlled in certain situations. In this instance, a voltage of the pre-scan pulse may be increased in order to obtain the same effect as increasing the width of the pre-scan pulse when the address pulse switching is frequent. Therefore, the width of the pre-scan pulse may be reduced so that the sustain period may be lengthened to increase brightness.

While this invention has been described in connection with what is presently considered to be practical exemplary embodiments, it is to be understood that the invention is not limited to the disclosed embodiments but, on the contrary, is intended to cover various modifications and equivalent arrangements included within the spirit and scope of the appended claims.

What is claimed is:

1. A plasma display device, comprising:

a plasma display panel having a plurality of address electrodes, a plurality of scan electrodes, and a plurality of sustain electrodes;

a controller receiving an image signal and generating subfield data, a scan electrode driving signal, a sustain electrode driving signal, and an address electrode driving signal; and a scan electrode driver applying a voltage to a scan electrode of the plurality of scan electrodes corresponding to the scan electrode driving signal, wherein the scan electrode driver applies a scan pulse that falls from a first voltage level to a second voltage level during an address period, and the scan electrode driver applies a pre-scan pulse of a third voltage level, which is higher than the first voltage level, between a reset period and the address period, and wherein a width of the pre-scan pulse is controlled according to patterns of subfield data.

2. The plasma display device of claim 1, wherein the scan electrode driver increases the width of the pre-scan pulse as a frequency of address pulse switching operations increases.

3. The plasma display device of claim 1, wherein the controller comprises:

a subfield data generator receiving an image signal and generating subfield data;

a data change detector detecting changes in subfield data; and a calculator calculating and outputting the width of the pre-scan pulse according to changes in subfield data.

4. The plasma display device of claim 3, wherein the calculator stores the width of the pre-scan pulse corresponding to a respective change in subfield data as a mapping table in an internal memory.

5. A plasma display device, comprising:

a plasma panel having a plurality of address electrodes, a plurality of scan electrodes, and a plurality of sustain electrodes;

a controller receiving an image signal and generating subfield data, a scan electrode driving signal, a sustain electrode driving signal, and an address electrode driving signal; and a scan electrode driver applying a voltage to a scan electrode of the plurality of scan electrodes corresponding to the scan electrode driving signal, wherein the scan electrode driver applies a scan pulse that falls from a first voltage level to a second voltage level during an address period, and applies a pre-scan pulse of a third voltage level, which is higher than the first voltage level, between a reset period and the address period, and wherein the third voltage level of the pre-scan pulse is controlled according to patterns of subfield data.

6. A method for driving a plasma display panel, comprising:

dividing an image frame into a plurality of subfields, a subfield including a reset period, an address period, and a sustain period;

applying to a scan electrode a reset waveform during the reset period;

applying to the scan electrode a scan pulse that falls from a first voltage level to a second voltage level during the address period;

applying to the scan electrode a pre-scan pulse of a third voltage level, which is higher than the first voltage level, between the reset period and the address period; and adjusting the pre-scan pulse according to patterns of subfield data.

7. The method of claim 6, wherein adjusting the pre-scan pulse comprises adjusting a width of the pre-scan pulse.

8. The method of claim 7, wherein the width of the pre-scan pulse is increased as a frequency of address pulse switching operations for the address data is increased.

9. The method of claim 7, wherein the width of the pre-scan pulse is reduced and a length of the sustain period is increased as the frequency of address pulse switching operations for the address data is decreased.

10. The method of claim 6, wherein adjusting the pre-scan pulse comprises adjusting a magnitude of the third voltage level of the pre-scan pulse.

* * * * *